United States Patent [19]

Garcia

[11] Patent Number: 4,853,989

[45] Date of Patent: Aug. 8, 1989

[54] DEVICE FOR FOLDING OR RETRACTING A BED, OR ITS ANALOGUE INTO A FALSE CEILING

[76] Inventor: Michel Garcia, "Rabajou Bellevue"—Saint Marcel Saint Sylvestre, 47140 Pennes D'Angenais, France

[21] Appl. No.: 222,923

[22] Filed: Jul. 22, 1988

[30] Foreign Application Priority Data

Jul. 22, 1987 [FR] France ..... 87 10510

[51] Int. Cl.[4] ..... A47C 17/84

[52] U.S. Cl. ..... 5/10 B; 5/1; 52/39; 182/78

[58] Field of Search ..... 5/10 R, 10 B, 2 R, 1; 52/36, 39; 312/245; 182/77, 78, 79, 80, 81

[56] References Cited

U.S. PATENT DOCUMENTS

| | | | |
|---|---|---|---|
| 67,494 | 8/1867 | Burnett | 5/10 B |
| 1,300,694 | 4/1919 | Bostwick | 5/10 B |
| 2,526,562 | 10/1950 | Kelly et al. | 5/10 B |
| 2,645,787 | 7/1953 | Will | 5/10 B |
| 3,829,912 | 8/1974 | Quakenbrush | 5/10 B |
| 4,243,260 | 1/1981 | Gieseking | 5/10 B X |
| 4,699,437 | 10/1987 | Genereaux | 52/39 X |

FOREIGN PATENT DOCUMENTS

| | | | |
|---|---|---|---|
| 475988 | 8/1951 | Canada | 5/10 R |
| 182731 | 5/1986 | European Pat. Off. . | |

*Primary Examiner*—Gary L. Smith
*Assistant Examiner*—Michael J. Milano
*Attorney, Agent, or Firm*—Robert J. Koch

[57] ABSTRACT

The invention concerns a device to unfold and retract a bed, a sofa or something similar into a structure in a false ceiling. The object of the invention is a device that unfolds and retracts a bed, or the like designed to be integrated in a system of suspended devices. This invention comprises a panel composed of ceiling elements (5,6) that when closed, in a horizontal position, forms a false ceiling (2). The panel is hinged to move between two stable positions: the horizontal, closed position; and the vertical, open position. Attached to the inside face of the panel and parallel to it is a fixed frame (4). Slidable attached to the fixed frame is a mobile frame (9). Articuably mounted to the mobile frame, about an axis (13) parallel to the panel's axis of articulation (7), and at a point at the end of the mobile frame farthest from the panel's axis of articulation (7) is a furniture frame (12).

23 Claims, 4 Drawing Sheets

DEVICE FOR FOLDING OR RETRACTING A BED, OR ITS ANALOGUE INTO A FALSE CEILING

BACKGROUND TECHNOLOGY

The present invention concerns a device to unfold and retract a bed, a couch, or similar furniture into a structure in a false ceiling.

DESCRIPTION OF THE RELATED TECHNOLOGY

More precisely, the invention concerns a folding and retracting mechanism intended to be integrated in a system of suspended devices of the type described in EP-A-No. 0182731. That patent describes a device for the suspended arrangement of juxtaposed individual tilting compartments. Each compartment of the system is situated on the upper face of a flat panel, and articulated around its longitudinal axis on two pieces fixedly mounted on the two lateral ends of the panel. Each panel can be locked in an open or closed position. The panels are aligned orthogonally to their tilting axes, side by side, parallel to each other and without any stationary structural element being interposed between them.

The multiple shelving system is variable at will. One can expand it in any direction into a checkered pattern of compartments, by virtue of its single lower face of panels, without projections or recesses. The result is a false ceiling which is both pleasing in appearance and functional.

SUMMARY OF THE INVENTION

The object of the present invention s to integrate a mechanism for unfolding a bed, a couch, or the like, out of a false ceiling system. It comprises plain, rectangular, juxtaposed panels tiltably mounted between two stable positions: a horizontal position when the mechanism is closed or retracted, and a vertical position when the mechanism is open or unfolded. In the horizontal position the panels form the false-ceiling. The mechanism is mounted on a fixed frame located on the internal face of at least one panel, and on a mobile frame slidably mounted, and parallel to the fixed frame. The furniture frame for the bed, or the like is mounted on the mobile frame, and articulated about an axis parallel to the axis of articulation of the panel.

This mechanism permits one to easily unfold a bed, a couch, or the like. One simply opens a panel in the false ceiling, the mobile frame descends vertically, and the furniture frame pivots the bed into a horizontal position.

Preferably, a variable system of biasing, such as a gas charged biasing device, is secured between the fixed frame, and the mobile frame to facilitate the sliding movement of the mobile frame and the furniture frame along the fixed frame.

The furniture frame can have feet foldably fixed to it. Preferably, the feet would be adjustable to vary the height of the a bed, or its analogue.

In order to make the furniture frame and the bed, for example, it is possible to construct the furniture frame from a series of folding, articulated sections. This also effectively reduces the length of the furniture frame and the bed, or its analogue.

BRIEF DESCRIPTION OF THE DRAWINGS

The following descriptions in reference to the attached drawings of the embodiments of the invention will reveal its other characteristics and advantages. It should be understood, however, that the matter following is illustrative only and should not be taken in any way as a restriction on the generality of the description above.

DETAILED DESCRIPTION OF THE DRAWINGS

Figure 1:
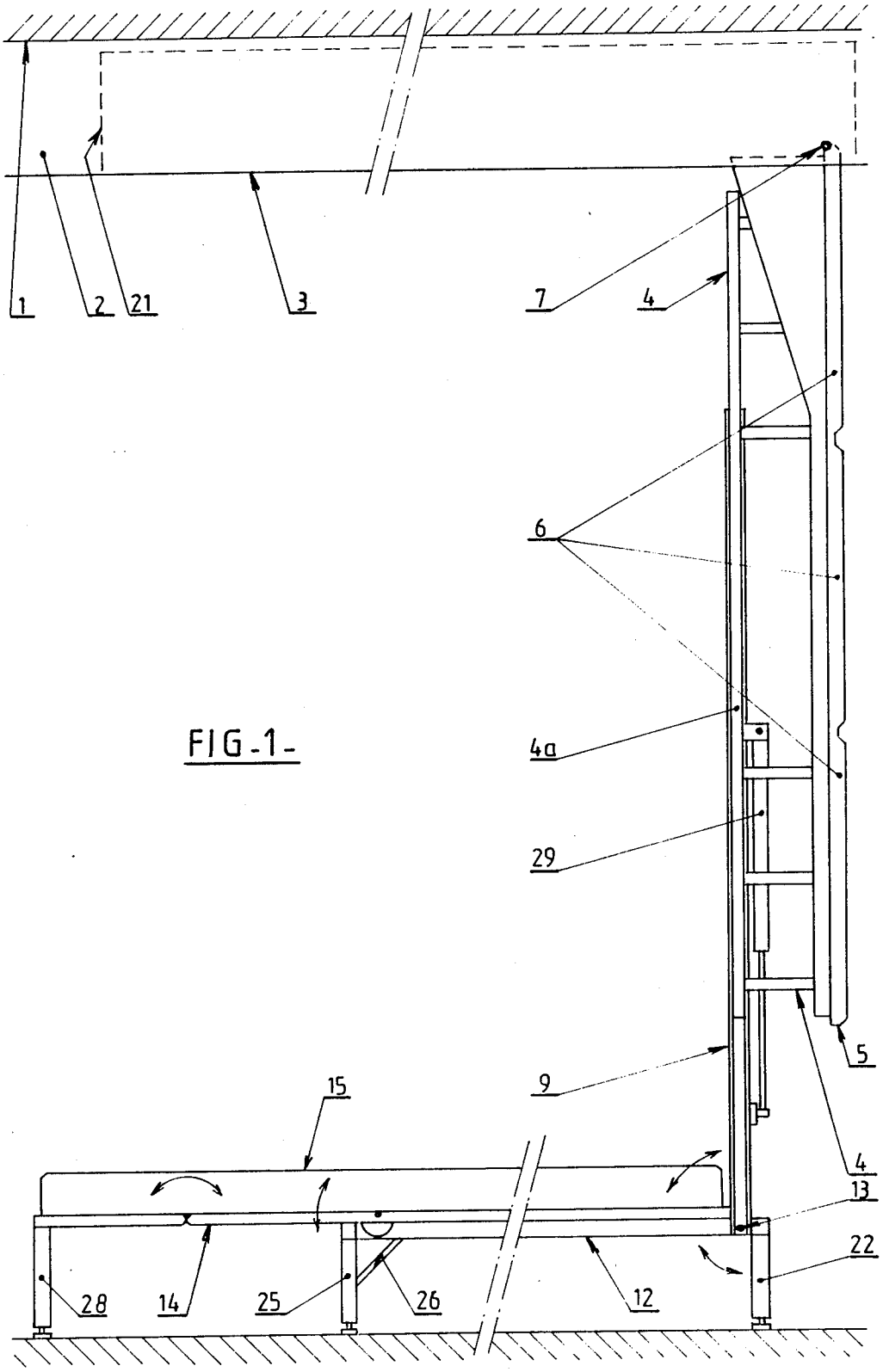
FIG. 1 is a lateral view of an embodiment of the described device unfolded.
Figure 2:
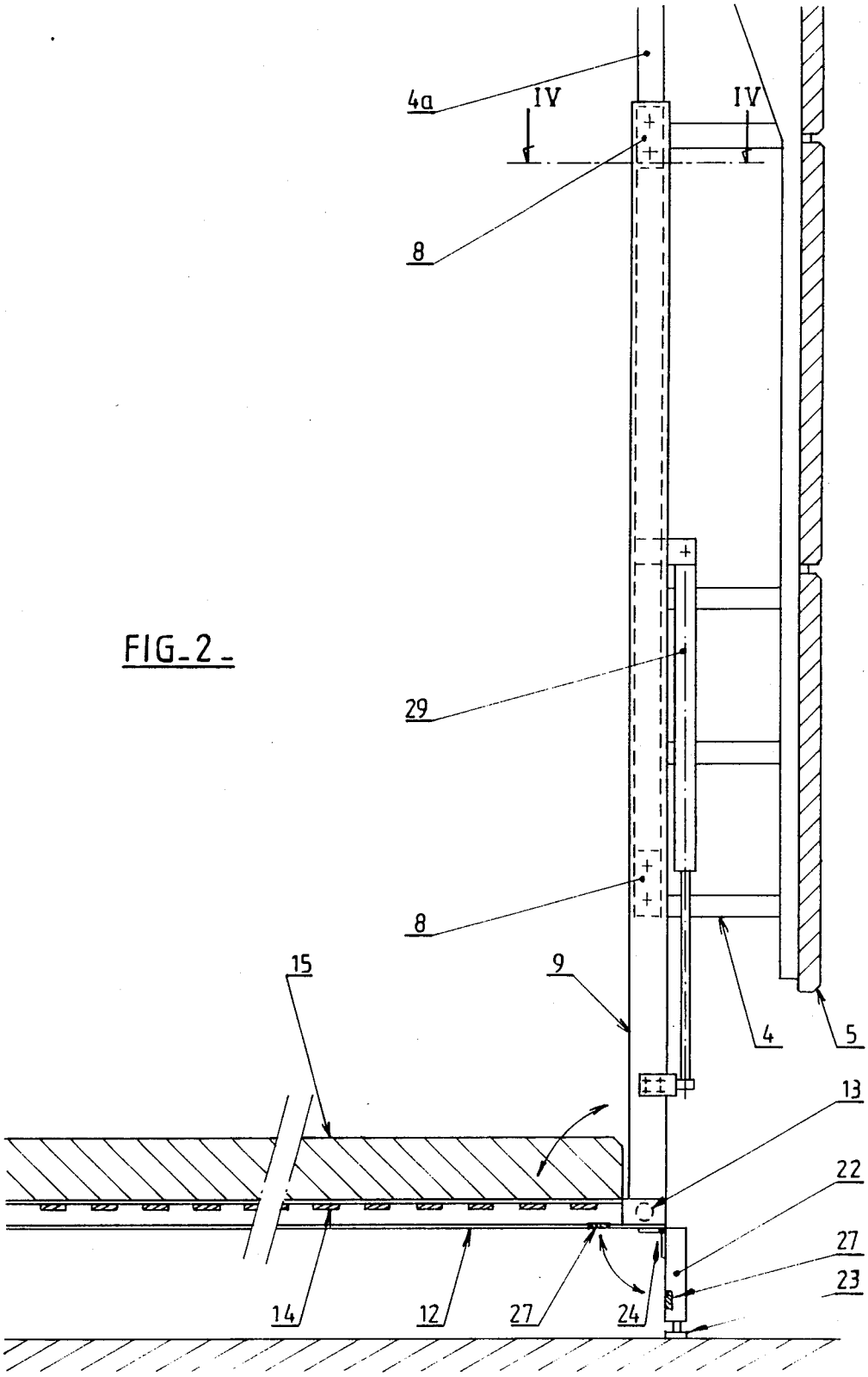
FIG. 2 is an enlarged vertical section of the embodiment shown in FIG. 1.

Represented schematically in FIG. 1 are the ceiling 1; a section 2 of the integrated ceiling system forming a false ceiling; and the lower face 3 of the false ceiling.

The device according to the described embodiment comprises a fixed frame 4 mounted on the internal face of a ceiling panel 5 which consists of three ceiling elements 6 joined together.

The ceiling panel 5 is suspended and articulated from the false ceiling 2,3, and conforms to the description for the corresponding parts described in EP-A-No. 0182 731.

The ceiling panel 5 is articulated around the fixed horizontal axis 7, and has two stable positions. In one position, the ceiling elements 6 are horizontal and even with other ceiling elements of the false ceiling 2,3. In the other position, the ceiling elements 6 are vertical. A system of weights (not illustrated) permits one to change the position of the device with a reasonable effort. For more details relative to other parts of the ceiling system, see EP-A-No. 0182 731.

The fixed frame 4, in the representation, is comprised of two facing elements each approximately in the form of a ladder positioned parallel and close to the longitudinal edge of the ceiling panel 5. The ladder has one upright **4*a* on each side of the fixed frame 4** positioned on appropriate distance from the ceiling panel to define an area of sufficient size to contain the folded bed.

A mobile frame of U-shaped glides 9, illustrated in the embodiment of FIG. 1 as two parallel edges, is slidably fixed around the external surface of each upright **4*a*. To assure the movement of the mobile frame and its retention around the uprights 4*a*, the uprights 4*a* have penetrating projections 8 with protrusions 10. The channel of each glide has corresponding complementary intrusions 11 to the protrusions 10** on the uprights' projections.

The U-shaped glides 9 are connected to each other at their extreme furthest ends from the pivot point of the ceiling panel 5 by the furniture frame 12. The furniture frame 12 is articulable connected at these points of attachment to the glides 9.

The U-shaped glides can, of course, be connected to each other by cross pieces at their opposite ends.

The furniture frame 12 could, for example, be constructed of L-shaped angle iron and serve as a support 14 for a mattress 15.

The described embodiment illustrates a mattress 15 and a support 14 composed of several, foldable parts.

Figure 3:
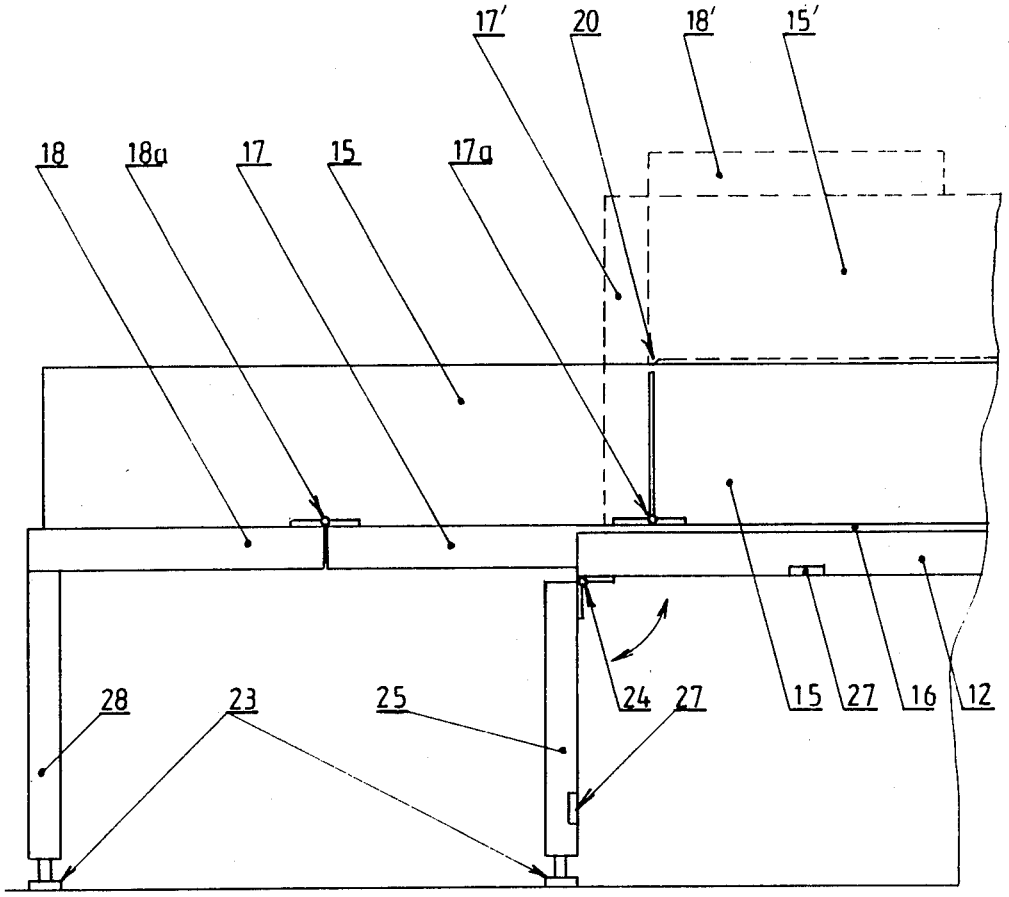
FIG. 3 is an enlarged view of another section of the embodiment shown in FIG. 1.
Figure 4:
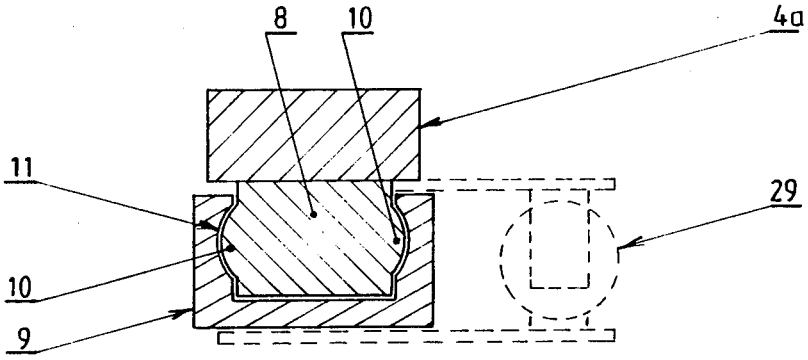
FIG. 4 is a vertical cross section through the line IV as shown in FIG. 2.

The support 14 could, for example, be constructed of a lath frame 16 (in FIG. 3), fitted to the furniture frame 12 and retained there by appropriate means, and increased in length by a first extension frame 17 and a second extension frame 18 articuably fixed to each other. The hinged articulations 17*a* and 18*a* between the frames 16 and 17, and 17 and 18 permit folding the mattress along the axis 20 into the position 15' and then folding the frame at right angles around the mattress into the positions indicated in FIG. 3 as 17' and 18'.

Folding frames of this type permit a significant reduction in the length of the folded bed, or its analogue. As a result the furniture frame 12, and the mobile frame 4, are reduced in size. Consequently, the length of the space 21 in the false ceiling required to accommodate the retracted bed is also diminished.

The furniture frame 12 also has at the end closest to the axis 13 feet 22 that retract against the interior face of the furniture frame 12. The feet 22 are pivotably mounted on the frame at one end with hinges 24, and have at the other end screw jacks 23 for adjusting their height. At the opposite end of the furniture frame 12 are mounted analogous feet 25. Angular braces 26 are positioned to keep the feet unfolded. The feet 22, 25 can be held in a retracted position by any appropriate means, for example, by magnets 27 fixed in appropriate positions.

The end of the lath frame 18 also has comparable feet 28 with screw jacks 23 that retract against the extreme end of the mattress parallel to the axis of articulation.

Between the mobile frame 9 and the fixed frame 4 a variable gas charged biasing device 29 is fixed. The biasing device is mounted parallel to an upright 4*a* of the fixed frame with one end attached the upright 4*a* and the other end attached to the interior face of the mobile frame.

Any appropriate means can be used to keep the folded bed 15, the furniture frame 12, and the mobile frame 9 from pivoting along the axis 13 out of a vertical position.

A stop, positioned for example on the superior face of the mobile frame 9 to contact the projection 8 appropriately, could be affixed to limit the distance of descent of the mobile tracks.

Figure 5:
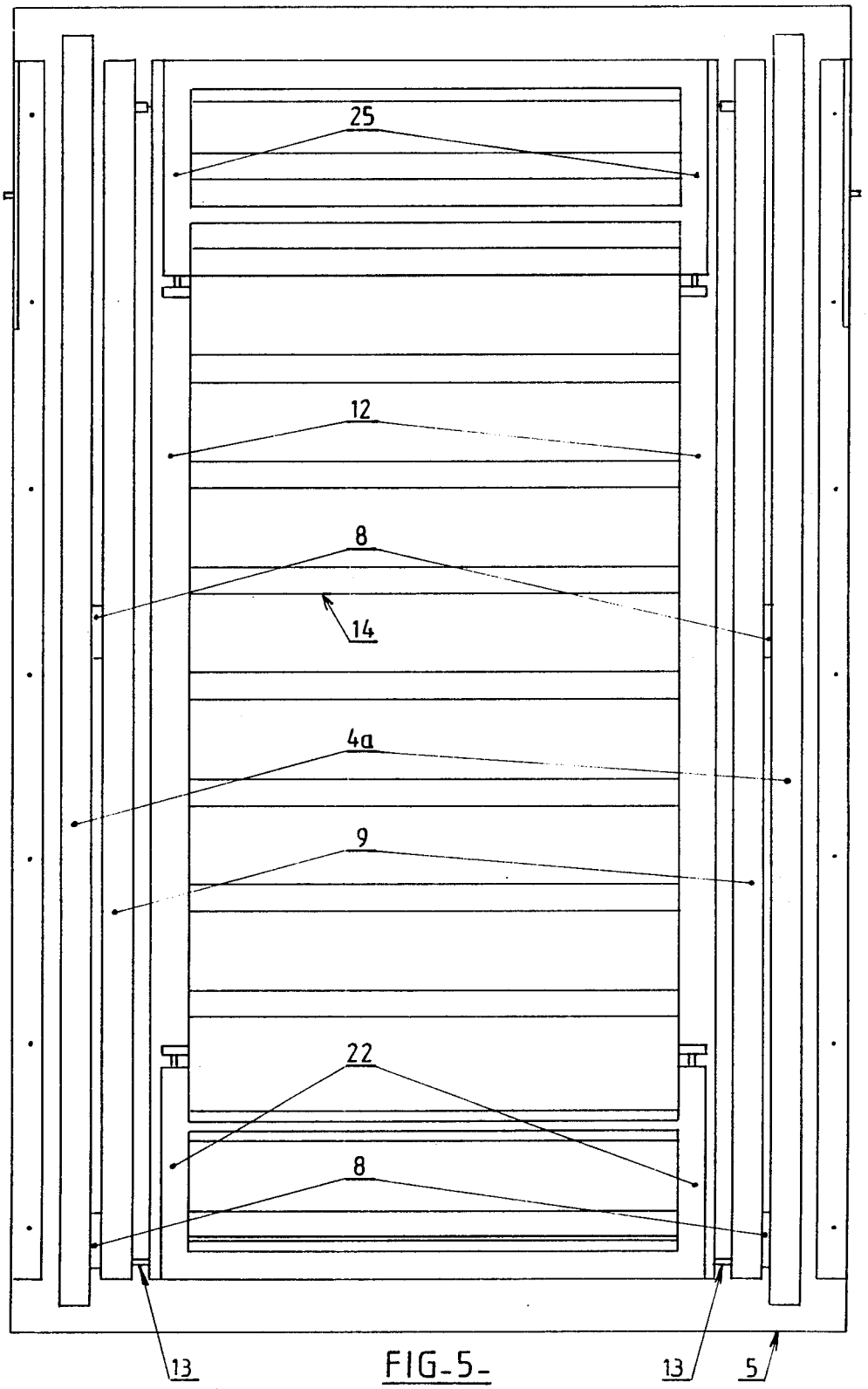
FIG. 5 is a view from the left side of the embodiment shown in FIG. 1, looking at the bottom of the bed folded into a vertical position so that the furniture frame is in the same plane as the retracted mobile frame and the fixed frame.

The gas charged biasing device 29 is adjusted to balance the weight of the moveable parts of the invention so that when they are in a vertical position (as illustrated in FIG. 5) they can be easily moved up (when the biasing device 29 retracts) and down (when the biasing device 29 extends).

In the position of FIG. 5, the feet 22 and 25 are retracted, and the invention is ready to be folded into the false-ceiling by pivoting the ceiling panel 5 around the axis 7. The effort necessary to pivot the ceiling panel 5 is greatly reduced by the biasing system attached to the ceiling panel 5, as previously mentioned.

Raising or lowering the panel is accomplished while holding the edge of the ceiling panel 5 farthest from the pivotal axis 7.

The ceiling panel 5 is constructed from three combined ceiling elements 6 for esthetic reasons. This gives the false ceiling visible continuity since these three panels are identical in appearance to the other ceiling panels. Thus, the position of the a bed, or the like is invisible.

The frames 12 and 14 do not necessarily need feet, they could rest directly on the floor.

The device of the invention can be applied to any kind of frame be it folding or not, for lying, sleeping, or sitting. If the device is adapted for sitting, the furniture frame 12 would be the seat, and together with the mobile frame 9, the back rest.

It would also be a simple matter to attach lighting for a bed, or the like in the space between the fixed frame 4 and the ceiling panel 5.

The invention is obviously not limited to the described embodiment. It is meant to cover all the variations of form, dimension, and arrangement of the fixed frame 4, the mobile frame 9, and the furniture frame 12 with a bed, or its analogue.

I claim:

1. A device to unfold and retract furniture into a false ceiling which comprises:

a panel pivoting about a first axis of articulation between a horizontal, closed position and a vertical, open position, said panel defining a part of said false ceiling; a fixed frame, mounted on the internal face of said panel;

a mobile frame slidably mounted on said fixed frame and parallel to said panel;

a furniture frame attached to said furniture, said furniture frame being articulably mounted around a second axis, located at the end of said mobile frame opposite from said panel's first axis of articulation.

2. A device according to claim 1, further comprising a variable biasing device mounted between said fixed frame and said mobile frame.

3. A device, according to claim 1, further comprising feet articulably and retractably mounted on said furniture frame.

4. A device according to claim 1, in which said furniture frame comprises a plurality of foldable extension frames, the combined length of said folded frames and said furniture frame being equal to the unfolded length of said furniture.

5. A device according to claim 1, further comprising a fixed frame constructed of two uprights mounted parallel at a distance from said panel;

wherein said mobile frame comprises U-shaped glides slidably fixed to said uprights, and said furniture frame is pivotably mounted at one end of said mobile frame.

6. A device according to claim 1, in which said panel comprises a plurality of ceiling elements adjacent to and identical with other panels of said false ceiling, said panel and said other panels being articulated from the structure of said false ceiling.

7. A device, according to claim 1, wherein said furniture is a bed, a chair, a chaise, or a couch.

8. A device, according to claim 7, further comprising a variable biasing device mounted between said fixed frame and said mobile frame, wherein said biasing device is gas charged.

9. A device, according to claim 7, further comprising feet, articulably and retractably mounted on said furniture frame.

10. A device according to claim 7, in which said furniture frame comprises a plurality of foldable extension frames, the combined length of said folded frames and said furniture frame being equal to the unfolded length of said furniture.

11. A device according to claim 7 further comprising a fixed frame constructed of two uprights mounted parallel at a distance from said panel;

wherein said mobile frame comprises U-shaped glides slidably fixed to said uprights, and said furniture frame is pivotably mounted at one end of said mobile frame.

12. A device according to claim 7, in which said panel comprises a plurality of ceiling elements adjacent to and identical with other panels of said false ceiling, said panel being articulated from the structure of said false ceiling.

13. A device, according to claim 2, wherein said biasing device is gas charged.

14. A device, according to claim 2, further comprising feet, articuably and retractably mounted on said furniture frame.

15. A device according to claim 2, in which said furniture frame comprises a plurality of foldable extension frames, the combined length of said folded frames and said furniture frame being equal to the unfolded length of said furniture.

16. A device according to claim 2, comprising a fixed frame constructed of two uprights mounted parallel at a distance from said panel;

wherein said mobile frame comprises U-shaped glides slidably fixed to said uprights, and said furniture frame is pivotably mounted at one end of said mobile frame.

17. A device according to claim 2, in which said panel comprises a plurality of ceiling elements adjacent to and identical with other panels of ceiling elements adjacent to and identical with other panels of said false ceiling, said panel being articulated from the structure of said false ceiling.

18. A device according to claim 3, in which said furniture frame comprises a plurality of foldable extension frames, the combined length of said folded frames and said furniture frame being equal to the unfolded length of said furniture.

19. A device according to claim 3, further comprising a fixed frame constructed of two uprights mounted parallel at a distance from said panel;

wherein said mobile frame comprises U-shaped glides slidably fixed to said uprights, and said furniture frame is pivotably mounted at one end of said mobile frame.

20. A device according to claim 3, in which said panel comprises a plurality of ceiling elements adjacent to and identical with other panels of said false ceiling, said panel being articulated from the structure of said false ceiling.

21. A device according to claim 4, further comprising a fixed frame constructed of two uprights mounted parallel at a distance from said panel;

wherein said mobile frame comprises U-shaped glides slidably fixed to said uprights, and said furniture frame is pivotably mounted at one end of said mobile frame.

22. A device according to claim 4, in which said panel comprises a plurality of ceiling elements adjacent to and identical with other panels of said false ceiling, said panel being articulated from the structure of said false ceiling.

23. A device according to claim 5, in which said panel comprises a plurality of ceiling elements adjacent to and identical with other panels of said false ceiling, said panel being articulated from the structure of said false ceiling.

* * * * *